US009889064B1

(12) United States Patent
Olivares et al.

(10) Patent No.: US 9,889,064 B1
(45) Date of Patent: Feb. 13, 2018

(54) SEXUAL STIMULATION DEVICE WITH AN OSCILLATOR FEATURE

(71) Applicant: Shenzhen Aigan Technology Co. Ltd., Shenzhen (CN)

(72) Inventors: Eddy Olivares, Guangzhou (CN); Dan Liu, Guangzhou (CN)

( * ) Notice: Subject to any disclaimer, the term of this patent is extended or adjusted under 35 U.S.C. 154(b) by 0 days.

(21) Appl. No.: 15/370,218

(22) Filed: Dec. 6, 2016

(51) Int. Cl.
*A61H 19/00* (2006.01)
*A61H 23/02* (2006.01)

(52) U.S. Cl.
CPC ..... *A61H 19/44* (2013.01); *A61H 23/02* (2013.01)

(58) Field of Classification Search
CPC .... A61H 19/44; A61H 19/34; A61H 23/0263; A61H 19/32; A61H 2201/5097; A61H 23/02; A61H 2201/0153; A61H 19/40; A61H 19/50; A61H 19/00; A61H 9/0007
See application file for complete search history.

(56) References Cited

U.S. PATENT DOCUMENTS 5,519,292 A 5/1996 Taylor
8,900,120 B2 12/2014 Lewis
2003/0083599 A1 5/2003 Kitov
2004/0082831 A1* 4/2004 Kobashikawa ..... A61H 19/34 600/38
2013/0345501 A1* 12/2013 O'Reilly ..... A61H 19/44 600/38
2014/0309565 A1* 10/2014 Allen ..... A61H 19/44 601/46
2015/0359703 A1* 12/2015 Richardson, II ... A61H 23/0263 600/38

* cited by examiner

*Primary Examiner* — Christine H Matthews
(74) *Attorney, Agent, or Firm* — Steinberg Intellectual Property Law LLC; Gloria M. Steinberg, Esq.

(57) ABSTRACT

Disclosed is a sexual stimulation device that includes a phallus shaped member having a handle opposite a stimulation end. The handle includes a control button for operating the device. The control button is connected to a power source that can activate an oscillating motor, which is attached to a motor head having a motor head attachment and a silicone embedded connector. The motor head oscillates, thereby moving the motor head attachment and the silicone embedded connector therewith. The silicone embedded connector is aligned with a stimulation point at the stimulation end of the device such that when the device is activated, the stimulation point can oscillate. In use, the stimulation end can be inserted into a vagina to contact the g-spot or near the wall of the vagina to stimulate a user.

13 Claims, 4 Drawing Sheets

SEXUAL STIMULATION DEVICE WITH AN OSCILLATOR FEATURE

FIELD OF THE INVENTION

The present invention generally relates to sexual stimulation devices and adult toys. More particularly, the present invention is directed to a sexual stimulation device or an adult toy comprising an oscillator feature.

BACKGROUND OF THE INVENTION

Various types of sex toys are known in the prior art. Some of the most popular sex toys are designed to resemble human genitals and may be vibrating or non-vibrating. Particularly, vibrators comprise an insertable shaft that can have additional functionalities, such as rotation or thrusting motion. These motions are actuated via an electric vibrator motor that is controlled to alter the sensations produced by the toy.

For example, Lewis, U.S. Pat. No. 8,900,120, discloses a device comprising vibration means that can apply vibrations to a male or a female user. In this regard, the device of Lewis is not designed specifically for female anatomy. Similarly, Taylor, U.S. Pat. No. 5,519,292, discloses a fingertip massager that comprises vibrating pulsators that are attached to the user's fingers for vibrating the same. Thus, Taylor does not explicitly disclose a sexual stimulation device. Additionally, the aforementioned devices do not include a motor head or a connecting element that can oscillate to effectively target genital stimulation areas in women.

Another device, Kitov, U.S. Patent Application Publication No. 2003/0083599, discloses a vibratory massage device including a vibrating pad with a vibration element. While Kitov discloses that the vibration element is driven by electrical pulses and causes the pad to oscillate, the purpose and intent of the device of Kitov are different from the present invention in that Kitov does not disclose a sex toy or a sexual stimulation device.

While existing devices provide various functionalities, these devices lack means for targeting stimulation to one area via an oscillator so as to provide a pulsating or a throbbing motion. Therefore, there is a need for a sexual stimulation device intended for use by women that effectively targets the so-called g-spot, a nerve reflex area inside the vagina, along the anterior surface, or near the wall of the vagina. In this regard, the invention described herein addresses this problem.

SUMMARY OF THE INVENTION

In view of the disadvantages inherent in the known types of vibrating sexual stimulation devices now present in the prior art, the present invention provides an improved sexual stimulation device with an oscillator.

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form as to prelude to the more detailed description that is disclosed later.

Some embodiments include, for example, a sexual stimulation device comprising a generally phallus shaped member having a handle and a stimulation end. The handle comprises a control button for operating the device. The control button is connected to a power source that can activate an oscillating motor that is attached to a motor head having a motor head attachment and silicone embedded connector thereon. The silicone embedded connector is aligned with a stimulation point at the stimulation end so that when the device is activated, the stimulation point is configured to pulsate and/or oscillate instead of vibrating.

More particularly, the motor head is configured to move in an up-and-down motion so as to move the motor head attachment and the silicone embedded connector therewith. In operation, the stimulation end can be inserted into a vagina to contact the g-spot or near the wall of the vagina to stimulate the user.

It is, therefore, an objective of the present invention to provide a new and improved sexual stimulation device that is intended for use by women and that effectively targets genital stimulation areas in most women, namely the clitoris and surrounding skin, the inner surface of the vagina and, the G-spot.

It is another objective of the present invention to provide a new and improved sexual stimulation device that is anatomically shaped and that is ergonomic.

A final object of the present invention to provide a new and improved sexual stimulation device that may be readily fabricated from materials that permit relative economy and commensurate with durability.

In the light of the foregoing, these and other objectives are accomplished in accordance with the principles of the present invention, wherein the novelty of the present invention will become apparent from the following detailed description and appended claims.

BRIEF DESCRIPTION OF THE DRAWINGS

The above and other objects and advantages of the present invention will be apparent upon consideration of the following detailed description, taken in conjunction with the accompanying exemplary drawings, in which like reference characters refer to like parts throughout, and in which.

DETAILED DESCRIPTION OF THE INVENTION

The present invention is directed towards a sexual stimulation device. For purposes of clarity, and not by way of limitation, illustrative views of the present system and method are described with references made to the above-identified figures. Various modifications obvious to one skilled in the art are deemed to be within the spirit and scope of the present invention.

The word "exemplary" is used herein to mean serving as an example, instance, or illustration. Any aspect or design described herein as "exemplary" is not necessarily to be construed as preferred or advantageous over other aspects or designs. Rather, use of the word exemplary is intended to disclose concepts in a concrete fashion. As used in this application, the term "or" is intended to mean an inclusive "or" rather than an exclusive "or."

Additionally, the articles "a" and "an" as used in this application and the appended claims should generally be construed to mean "one or more" or "at least one" unless specified otherwise or clear from context to be directed to a singular form. Similarly, the terms "plurality" and "a plurality" as used herein includes, for example, "multiple" or "two or more." For example, "a plurality of items" includes two or more items.

Some embodiments may be used in conjunction with various devices and systems, for example, a personal computer (PC), a desktop computer, a mobile computer, a laptop, a tablet computer, a server computer, a handheld device, a personal digital assistant (PDA), a wireless communication device, a smart phone, a non-portable device, a wireless access point (AP), a wired or wireless router, a wired or wireless modem, a wired or wireless network, a local area network (LAN), a wireless LAN (WLAN), a metropolitan area network (MAN), a wireless MAN (WMAN), a wide area network (WAN), a wireless WAN (WWAN), a personal area network (PAN), a wireless PAN (WPAN), or networks operating in accordance with existing and/or future versions and/or derivatives of long term evolution (LTE), a device which incorporates a global positioning system (GPS) receiver or transceiver or chip, a device which incorporates an RFID element or chip, a multiple input multiple output (MIMO) transceiver or device, a single input multiple output (SIMO) transceiver or device, a multiple input single output (MISO) transceiver or device, a device having one or more internal antennas and/or external antennas, or the like.

Some embodiments of the present invention may include one or more wired or wireless links, may utilize one or more components of wireless communication (e.g., Bluetooth®), may utilize one or more methods or protocols of wireless communication, or the like. Some embodiments may utilize wired communication and/or wireless communication.

Figure 1:
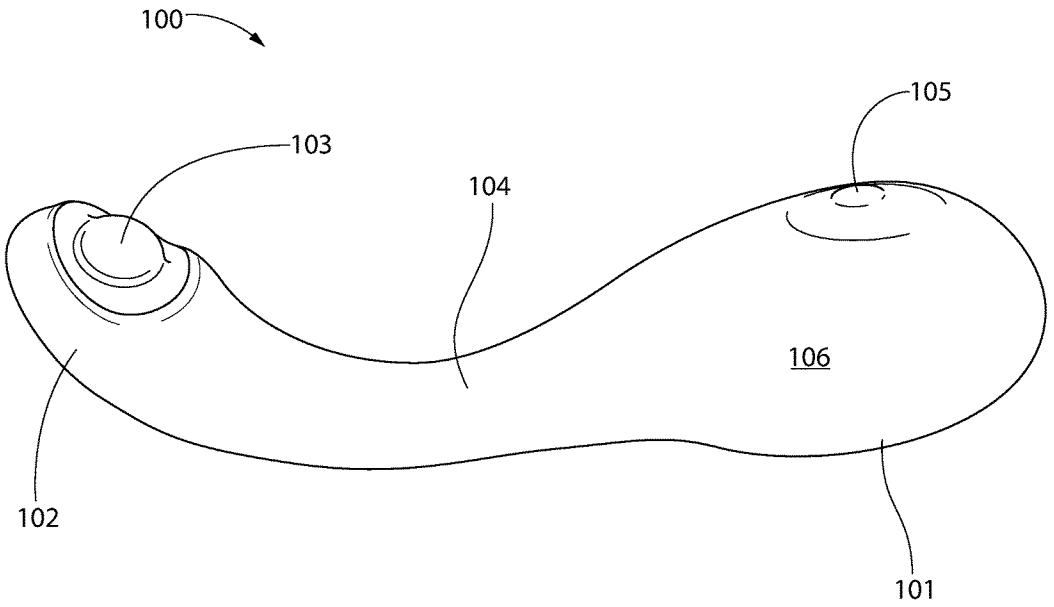
FIG. 1 depicts a perspective view of one embodiment of the present invention.
Figure 2:
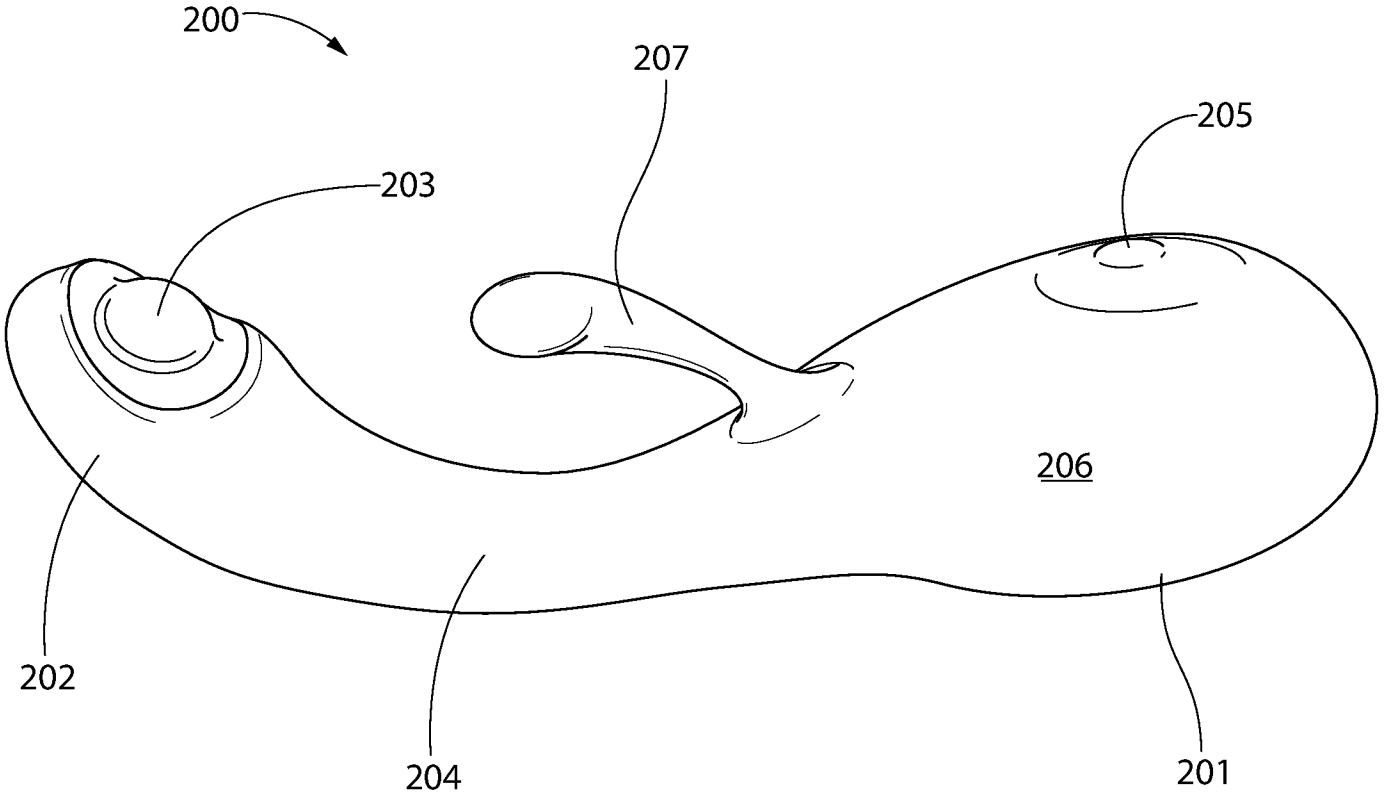
FIG. 2 depicts a perspective view of another embodiment of the present invention.

Referring now to FIGS. 1 and 2, there are shown perspective views of exemplary embodiments of the present invention. In some embodiments, the present invention comprises a sexual stimulation device 100, 200 comprising an elongated member or a shaft 104, 204 that is substantially phallus shaped. Preferably, the elongated member 104, 204 comprises a slight curvature so that it is ergonomic and can more easily access genital stimulation areas in most women.

The elongated member 104, 204 includes a first end 101, 201 opposite a second end 102, 202, wherein the first end 101, 201 comprises a handle having a control button 105, 205 thereon and the second end 102, 202 comprises a stimulation end having a stimulation point 103, 203. In some embodiments, the elongated member 104, 204 can comprise a backward S-shaped design (i.e., the handle and the stimulation end biased away from each other), a C-shaped design (i.e., the handle and the stimulation end biased toward each other so as to form a more pronounced curve), or a generally straight (i.e., more shaft-like) design.

Additionally, the elongated member 204 optionally comprises an arm 207 at a substantial midpoint thereof, wherein the arm 207 is configured to vibrate, oscillate, or move in such a way so as to stimulate the clitoris and surrounding skin. It is contemplated that the arm 207 can be activated when the device 100, 200 is in operation.

The surface 106, 206 of the device 100, 200 comprises a silicone casing or another suitable type of casing. Preferably, the casing is seamless so as to provide one continuous skin-like surface that is smooth and soft. It is contemplated that the silicone casing can comprise various textures, such as ridges and/or bumps so as to provide additional stimuli to the user, depending upon the embodiment.

In some embodiments, the control button 105, 205 of the handle 101, 201 can be connected to a switch disposed in the interior of the elongated member 104, 204. The control button 105, 205 can be depressed to turn on or turn off the device 100, 200. Additionally, the control button 105, 205 can be depressed or pushed a predetermined number of times to change the speed or tempo of the oscillator. For example, the control button 105, 205 can be depressed once to operate the device at a low speed, and then depressed twice to operate the device at a medium speed, and so on, until the device is turned off. In this way, the control button 105, 205 can be used to alter the sensations.

The stimulation end 102, 202 comprises a depressed portion having a protruding annular stimulation point 103, 203 centrally located thereon, wherein the stimulation point 103, 203 is aligned with a silicone embedded connector therebelow, disposed within the elongated member 104, 204. The stimulation point 103, 203 is configured to oscillate, pump, thrust, pump, and/or pulsate so that it moves inward and outward (i.e., up-and-down).

Figure 3:
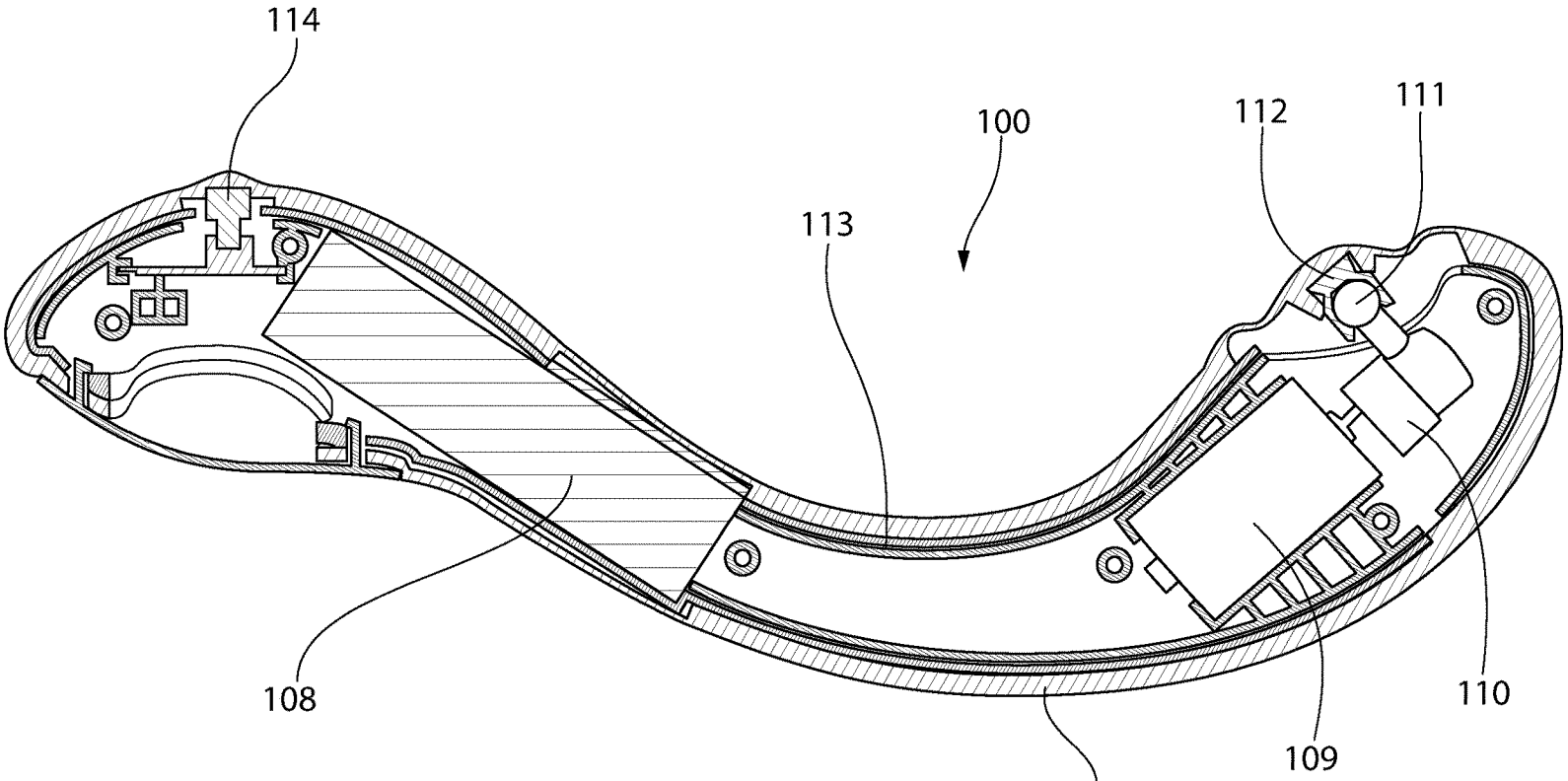
FIG. 3 shows a cross-sectional view of the present invention.
Figure 4:
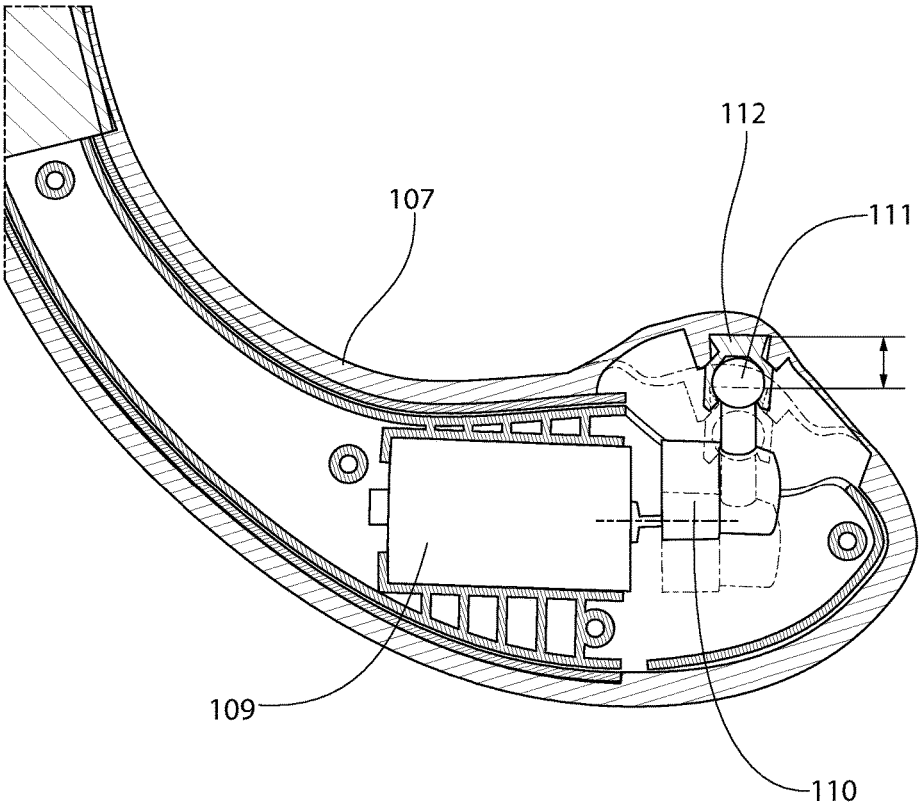
FIG. 4 shows a close-up cross-sectional view of the present invention.

Referring now to FIGS. 3 and 4, there are shown cross-sectional views of the present invention. The device 100 comprises a frame or a skeleton 113 that is enclosed in a silicone casing 107 that comprises a smooth and soft skin-like surface. The frame 113 comprises a defined interior volume for enclosing electrical components therein.

The first end of the device 100 comprises a switch 114 that is connected to a power source (i.e., a battery, a rechargeable battery, etc.) 108 for supplying power to an oscillating motor 109, wherein the switch 114 can be actuated via the control button accessible from the exterior of the first end of the device 100. The oscillating motor 109 is connected to a motor head 110. The motor head 110 is connected to a motor head attachment 111, which is connected to a silicone embedded connector 112. More particularly, the motor head attachment 111 includes a first section that is connected to the motor head 110, and a second section comprising a rounded head that is connected to the base of the silicone embedded connector 112. The connector 112 is directly below the stimulation point so as to move the stimulation point up-and-down and provide oscillation.

The motor 109 is configured to move the motor head attachment 111 in a generally up-and-down direction in one place. Said another way, the motor head attachment 111 moves along the y-axis while remaining stationary along the x-axis. The movement path of the motor head 110, the motor head attachment 111 and the silicone embedded connector 112 are shown in FIG. 4. The motor head 110, the motor head attachment 111, and the silicone embedded connector 112 move as a single unit in an up-and-down direction so as to oscillate rather than vibrate.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A sexual stimulation device, comprising:

an elongated member having a first end and a second end;

said first end comprising a handle having a control button;

said second end comprising a stimulation end having a stimulation point, wherein said stimulation point comprises a portion of said stimulation end, further wherein said stimulation point is directly aligned with a silicone embedded connector disposed within said elongated member;

a motor connected to a motor head comprising a motor head attachment connected to said silicone embedded connector, wherein said motor head and said motor head attachment moves perpendicularly to a longitudinal axis of said motor in order to pulsate said stimulation point of said stimulation end in an isolated manner upon being activated via said control button while maintaining said stimulation end stationary.

2. The sexual stimulation device of claim 1, further comprising an arm disposed at a substantial midpoint of said elongated member.

3. The sexual stimulation device of claim 1, wherein said elongated member is substantially phallus shaped.

4. The sexual stimulation device of claim 1, wherein said elongated member is enclosed in a casing.

5. The sexual stimulation device of claim 1, further comprising a battery connected to said motor;

said battery connected to a switch that can be actuated via said control button.

6. The sexual stimulation device of claim 1, wherein said elongated member is curved.

7. The sexual stimulation device of claim 1, wherein said stimulation point comprises an annular depressed portion centrally located on said stimulation end.

8. A sexual stimulation device, comprising:

an elongated member enclosing a motor connected to a motor head, wherein said motor is connected to a power supply;

said motor head having a motor head attachment and silicone embedded connector thereon;

said motor configured to move said motor head attachment and said silicone embedded connector linearly in an up-and-down direction and perpendicular to a longitudinal axis of said motor, thereby pulsating said motor head attachment and said silicone embedded connector therewith in order to move an isolated point of said elongated member.

9. The sexual stimulation device of claim 8, wherein said power supply is a battery;

said battery connected to a switch that can be actuated via a control button on said elongated member.

10. The sexual stimulation device of claim 8, wherein said elongated member comprises a handle opposite a stimulation end;

said handle having a control button;

said stimulation end having a stimulation point, wherein said stimulation point is aligned with said silicone embedded connector;

said silicone embedded connector configured to oscillate upon being activated via said control button to raise and lower an entire portion of said stimulation point concurrently while maintaining said stimulation end stationary.

11. The sexual stimulation device of claim 8, wherein said elongated member is substantially phallus shaped.

12. The sexual stimulation device of claim 8, wherein said elongated member is enclosed in a casing.

13. The sexual stimulation device of claim 10, wherein said stimulation point comprises an annular depressed portion centrally located on said stimulation end.

* * * * *